US007068223B2

(12) United States Patent
Yoshida et al.

(10) Patent No.: US 7,068,223 B2
(45) Date of Patent: Jun. 27, 2006

(54) MULTIAXIAL ANTENNA CHIP

(75) Inventors: Yutaka Yoshida, Aichi (JP); Takayuki Hiramitsu, Aichi (JP); Akihito Kimura, Aichi (JP); Hirofumi Okada, Aichi (JP)

(73) Assignee: Kabushiki Kaisha Tokai Rika Denki Seisakusho (JP)

( * ) Notice: Subject to any disclaimer, the term of this patent is extended or adjusted under 35 U.S.C. 154(b) by 0 days.

(21) Appl. No.: 10/608,457

(22) Filed: Jun. 26, 2003

(65) Prior Publication Data

US 2004/0061660 A1 Apr. 1, 2004

(30) Foreign Application Priority Data

Jun. 27, 2002 (JP) ..... 2002-187995
Aug. 9, 2002 (JP) ..... 2002-233586

(51) Int. Cl.
*H01Q 1/38* (2006.01)

(52) U.S. Cl. ..... 343/700 MS; 343/786

(58) Field of Classification Search ..... 343/700 MS, 343/788, 787, 742, 713, 728, 867
See application file for complete search history.

(56) References Cited

U.S. PATENT DOCUMENTS 6,294,974 B1 * 9/2001 Fukumoto ..... 336/107
6,304,232 B1 * 10/2001 Brown et al. ..... 343/895
6,344,824 B1 * 2/2002 Takasugi et al. ..... 343/700 MS
6,388,636 B1 * 5/2002 Brown et al. ..... 343/866
6,407,677 B1 6/2002 Avenel et al.
6,421,013 B1 * 7/2002 Chung ..... 343/700 MS
6,582,887 B1 * 6/2003 Luch ..... 430/311
2002/0080083 A1 6/2002 Nantz et al.
2003/0062980 A1 4/2003 Scheible et al.
2004/0130500 A1 * 7/2004 Takei ..... 343/895

FOREIGN PATENT DOCUMENTS

DE 2732950 A1 2/1979
DE 3613861 A1 11/1987
DE 19533105 A1 10/1996
DE 19718423 A1 11/1998
DE 10055404 A1 9/2001
EP 0554 581 A1 8/1993
EP 0 615 260 A1 9/1994
EP 03013498.5-2220 1/2005
FR 2792594 A 10/2000
GB 1258450 A 12/1971
GB 236769 A 12/1998
JP 7-263238 10/1995

* cited by examiner

*Primary Examiner*—Tuyet Vo
*Assistant Examiner*—Huedung X. Cao
(74) *Attorney, Agent, or Firm*—Daniel B. Schein, Esq.

(57) ABSTRACT

A three-axis antenna chip includes a cross-shaped core made of a magnetic substance. The core includes an X-axis core piece and a Y-axis core piece. The core pieces are laid on top of each other such that the core pieces extend perpendicular to each other. An X-axis coil portion is provided about the X-axis core piece, and a Y-axis coil portion is provided about the Y-axis core piece. A Z-axis coil portion is provided about a Z-axis that is perpendicular to the X-axis core piece and the Y-axis core piece. The three-axis antenna chip thus constructed is advantageous in reducing the size.

17 Claims, 12 Drawing Sheets

MULTIAXIAL ANTENNA CHIP

BACKGROUND OF THE INVENTION

The present invention relates to a multiaxial antenna chip mounted on a circuit board or the like.

In recent years, various remote control apparatuses, such as a smart entry apparatus and a smart ignition apparatus, have been used in vehicles.

For example, as shown in FIG. 22, the remote control apparatus comprises a portable transmitter-receiver 101 that communicates with a transmission and reception device provided in a vehicle. The portable transmitter-receiver 101 is carried by a user of the vehicle. Further, one-axis antenna 102 is mounted in the portable transmitter-receiver 101 to transmit and receive an electric wave to and from the transmission and reception device.

Since the current portable transmitter-receiver 101 is massive, it has been desirable to further reduce its size. However, when an attempt is made to miniaturize the portable transmitter-receiver 101, it is difficult to reduce the sizes of parts such as a mechanical key 103. Thus, it is contemplated that electric parts such as the one-axis antenna 102 are miniaturized.

However, the portable transmitter-receiver 101 contains a plurality of (in FIG. 22, two) one-axis antennas 102 in order to receive reliably electric waves from many directions. These one-axis antennas 102 are arranged in different orientations. As a result, the portable transmitter-receiver 101 must contain a mounting space for the two one-axis antennas 102. This contributes to increasing the size of the entire portable transmitter-receiver 101.

Further, in this case, the one-axis antennas 102 are separately mounted on a circuit board 104. Accordingly, the one-axis antennas 102 may be misaligned with respect to each other. This reduces the directionality of the antennas.

SUMMARY OF THE INVENTION

It is an object of the present invention to provide a multiaxial antenna chip, which can be of reduced size.

To achieve the above object, the present invention provides a multiaxial antenna chip including a core and coil portions. The core includes at least two arm portions. Each arm portion extends in a direction different from the other arm portion and has a coil portion provided about it.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments, together with the accompanying drawings in which.

DETAILED DESCRIPTION OF THE PREFERRED EMBODIMENTS

With reference to FIGS. 1 to 7, description will be given of a first embodiment of the present invention.

Figure 1:
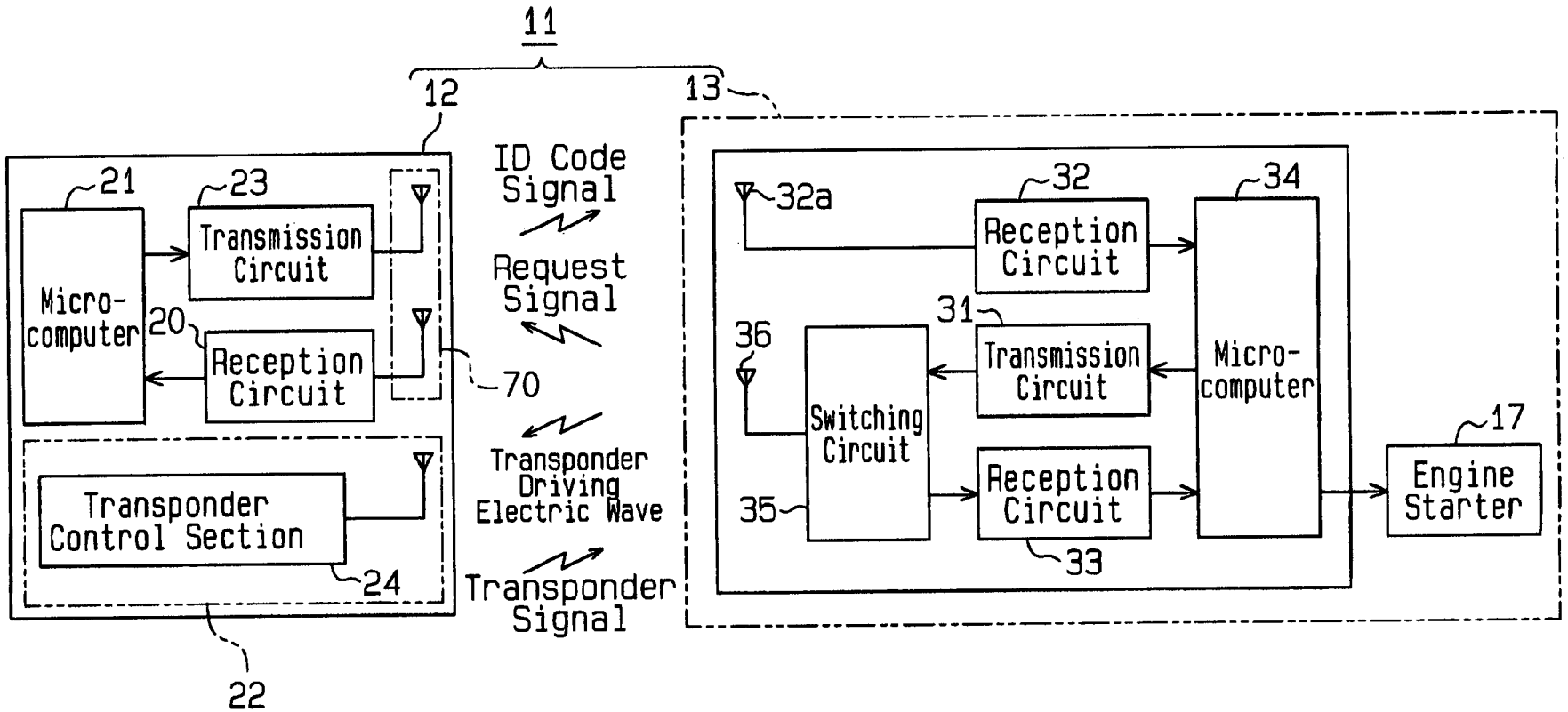
FIG. 1 is a block diagram showing an electric configuration of a vehicle remote control apparatus according to a first embodiment of the present invention.

As shown in FIG. 1, a vehicle remote control apparatus 11 comprises a transmission and reception device 13 provided in the vehicle and a portable transmitter-receiver 12 carried by a user. The transmission and reception device 13 comprises a transmission circuit 31, reception circuits 32 and 33, a microcomputer 34, and a switching circuit 35. The transmission circuit 31 and the reception circuits 32 and 33 are connected to the microcomputer 34. A transmission and reception antenna 36 is connected to the transmission circuit 31 and reception circuit 33 via the switching circuit 35. The switching circuit 35 allows the transmission and reception antenna 36 to be selectively connected to the transmission circuit 31 or the reception circuit 33. Further, a reception antenna 32*a* is connected to the reception circuit 32.

The transmission circuit 31 converts a request signal outputted by the microcomputer 34 into an electric wave of a predetermined frequency, and then outputs the electric wave via the transmission and reception antenna 36. Further, the transmission circuit 31 converts a transponder driving signal outputted by the microcomputer 34 into an electric wave of a predetermined frequency. The transmission circuit 31 thus generates a transponder driving current, and then outputs the current via the transmission and reception antenna 36. Specifically, both a request signal and a transponder driving current are outputted through the transmission and reception antenna 36. That is, the same antenna is used to output the request signal and the transponder driving current.

The reception circuit 32 can receive an ID code signal from the portable transmitter-receiver 12 via the reception antenna 32*a*. The reception circuit 32 demodulates its ID code signal into a pulse signal to generate a receive signal and then outputs the receive signal to the microcomputer 34. Further, the reception circuit 33 can receive a transponder signal from the portable transmitter-receiver 12 via the transmission and reception antenna 36. In this case, the transmission and reception antenna 36 is connected to the reception circuit 33 by the switching circuit 35. The reception circuit 33 demodulates its transponder signal into a pulse signal to generate a receive signal and then outputs the receive signal to the microcomputer 34.

An engine starter 17 is electrically connected to the microcomputer 34. The microcomputer 34 is composed of a CPU, a RAM, a ROM, and the like, which are not shown in the drawings. The microcomputer 34 selectively outputs the request signal and the transponder signal.

When a receive signal containing an ID code is inputted to the microcomputer 34, the latter compares a preset ID code with the ID code contained in the receive signal (collates the ID codes). If the ID codes match each other, the microcomputer 34 outputs a start permission signal to the engine starter 17.

Further, when a receive signal containing a transponder code is inputted to the microcomputer 34, the latter compares a preset transponder code with the transponder code contained in the receive signal (collates the transponder codes). If the transponder codes match each other, the microcomputer 34 outputs a start permission signal to the engine starter 17. An engine is started by rotating an operation knob, not shown in the drawings, while this signal is being outputted.

Further, as shown in FIG. 1, the portable transmitter-receiver 12 comprises a reception circuit 20, a microcomputer 21, a transmission circuit 23, and a transponder 22. The reception circuit receives a request signal from the transmission and reception device 13 via a three-axis antenna chip 70 as a multiaxial antenna chip and inputs this signal to the microcomputer 21. When the reception circuit 20 inputs a request signal to the microcomputer 21, the latter outputs an ID code signal containing a predetermined ID code. The transmission circuit 23 modulates the ID code signal into an electric wave of a predetermined frequency and transmits this electric wave to the transmission and reception device 13 via the three-axis antenna chip 70.

Further, the transponder 22 comprises a transponder control section 24. Upon receiving sufficient energy from an electromagnetic wave, the transponder control section 24 outputs a transponder signal containing an ID code (transponder code) for a predetermined transponder. Specifically, upon receiving a transponder driving electric wave from the transmission and reception device 13, the transponder control section 24 outputs a transponder signal.

Now, the structure of the portable transmitter-receiver 12 will be described.

Figure 2:
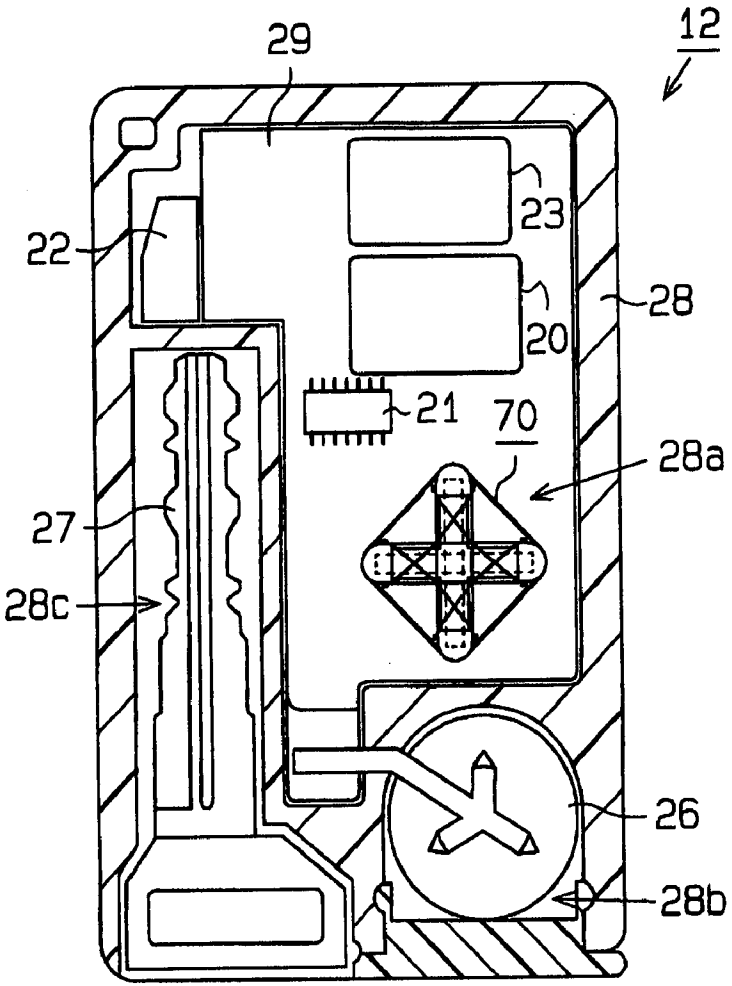
FIG. 2 is a sectional view of a portable transmitter-receiver.

As shown in FIG. 2, the portable transmitter-receiver 12 has a generally parallelepiped body formed by a case 28 made of a synthetic resin. The case 28 is partitioned into a battery housing section 28*b*, a mechanical key housing section 28*c*, and a circuit arranging section 28*a*. A battery 26 is accommodated in the battery housing section 28*b*. A mechanical key 27 is removably accommodated in the mechanical key housing section 28*c*. The reception circuit 20, the microcomputer 21, the transmission circuit 23, the transponder 22, and the three-axis antenna chip 70 are mounted on a circuit board 29 provided in the circuit arranging section 28*a*.

Figure 3:
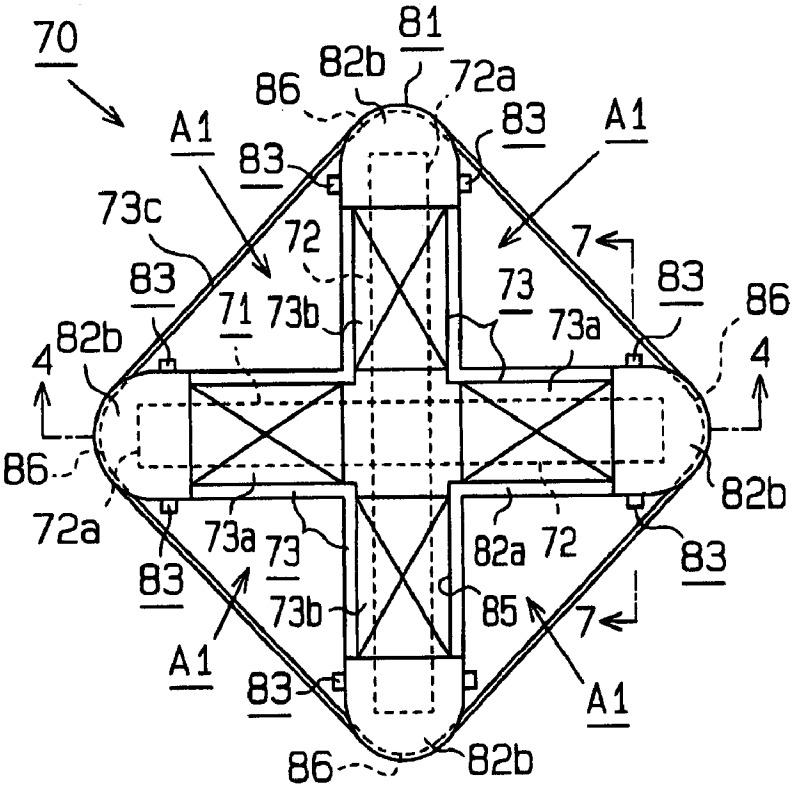
FIG. 3 is a front view of a three-axis antenna chip provided in the portable transmitter-receiver in FIG. 2.
Figure 4:
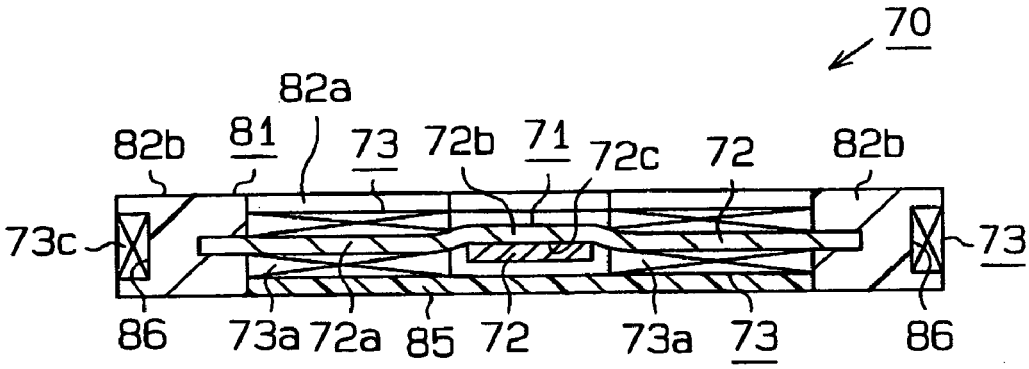
FIG. 4 is a sectional view taken along line 4—4 in FIG. 3.
Figure 5:
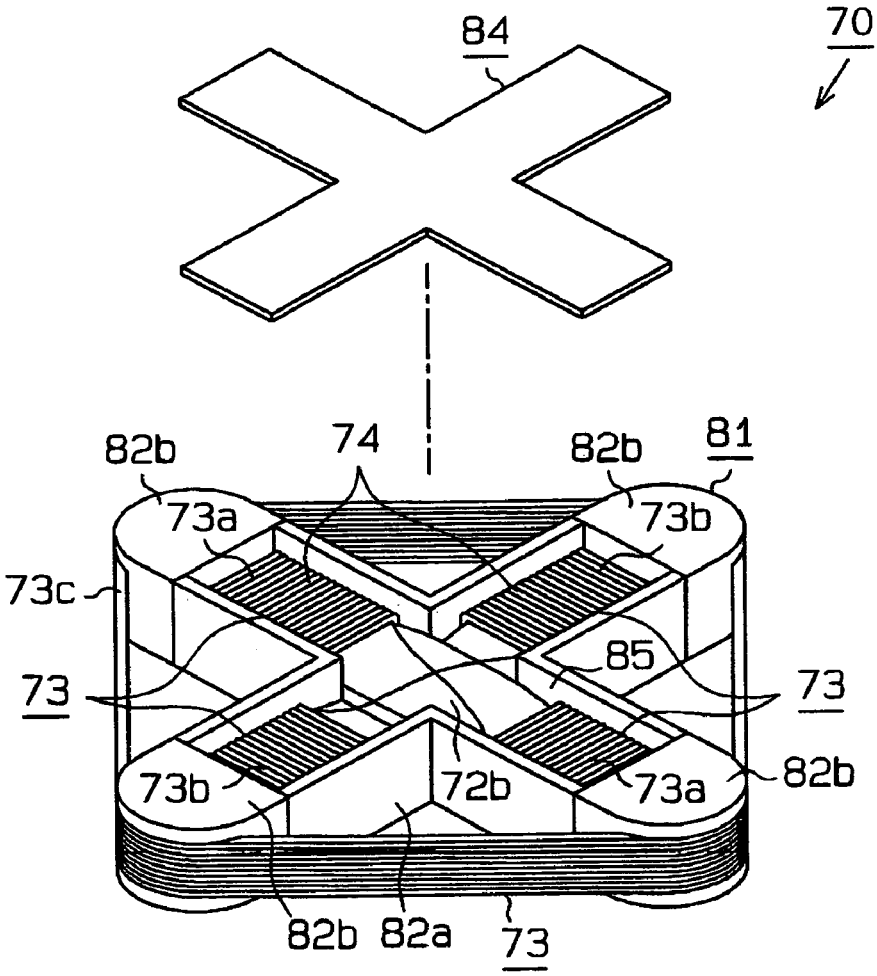
FIG. 5 is a perspective view of the three-axis antenna chip in FIG. 3.

As shown in FIGS. 3 to 5, the three-axis antenna chip 70 comprises a casing 81 made of a synthetic resin. The casing 81 has an opening, to which a transparent film 84 consisting of an insulator is stuck. The film 84 and the casing 81 are shaped generally like a cross. The casing 81 comprises a generally cross-shaped main body 82*a* having an accommodating concave portion 85 and caps 82*b* that close respective openings formed at the four corresponding ends of the main body 82*a*. The main body 82*a* is provided with a generally cross-shaped accommodating concave portion 85.

Figure 7:
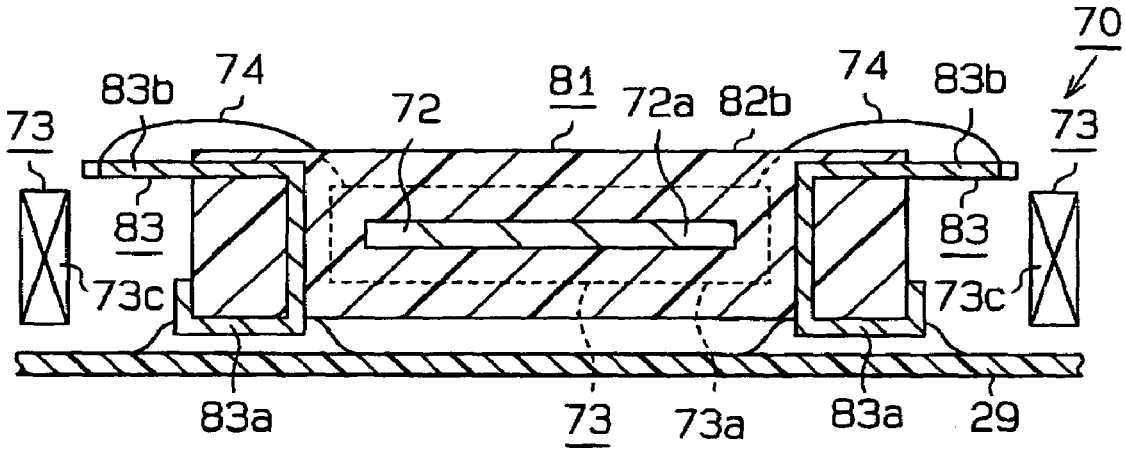
FIG. 7 is a sectional view taken along line 7—7 in FIG. 3.

Two metal contacts 83 are provided at the respective ends of each cap 82*b*. Specifically, eight contacts 83 are provided in the three-axis antenna chip 70. As shown in FIG. 7, each contact 83 is insert-molded in the corresponding cap 82*b*. The contact 83 has a mounting portion 83*a* projected from the cap 82*b* toward the circuit board 29 and having a generally L-shaped cross section and a connection portion 83*b* connected to an end of the mounting portion 83*a* and projected from the opposite sides of the cap 82*b*. The three-axis antenna chip 70 is fixed by soldering the mounting portion 83*a* to the circuit board 29.

As shown in FIGS. 3 to 5, a core 71 consisting of a magnetic substance is accommodated in the casing 81. As shown in FIG. 7, the core 71 is arranged so as not to interfere with each contact 83. The core 71 is constructed by forming a plurality of (in the present embodiment, four) bar-like arm portions 72*a* so that they extend in different directions. Specifically, the core 71 is generally cross-shaped by laying two band-like core pieces 72 on top of each other at their central portions. Thus, the core pieces 72 cross each other at right angles, and each arm portion 72*a* extends outward from the crossing portion of the two core pieces 72, or from the center of the core 71. One of the core pieces 72 is an X-axis core piece 72 that has a pair of X-axis arm portions 72*a*. The other core piece 72 is a Y-axis core piece 72 that has a pair of Y-axis arm portions 72*a*.

Figure 6:
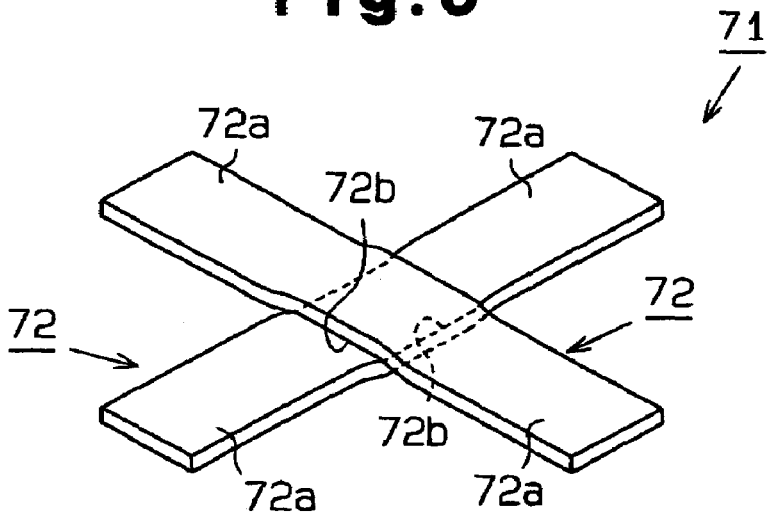
FIG. 6 is a perspective view showing a core provided in the three-axis antenna chip in FIG. 3.

As shown in FIGS. 4 to 6, a concave portion 72*b* is formed in the crossing portion of each of the two core pieces 72 by bending the core piece 72 in its thickness direction. When the two core pieces 72 are laid on top of each other, an inner side 72*c* of the concave portion 72*b* in one of the core pieces 72 contacts with the other core piece 72.

Further, the core pieces 72 are each constructed by stacking a plurality of (in the present embodiment, 30) core sheets. In the present embodiment, each core sheet has a board thickness of 15 to 20 μm. Further, each core sheet is formed of a flexible material. In the present embodiment, each core sheet is amorphous and is formed of an alloy consisting of Co and Ni.

Further, a coil portion 73 is formed around the arm portions 72*a* and the casing 81. The coil portion 73 is composed of a pair of X-axis coil portions 73*a*, a pair of Y-axis coil portions 73*b*, and a Z-axis coil portion 73*c*. The X-axis coil portions 73*a* and the Y-axis coil portions 73*b* are each constructed by winding an electric wire 74 around the corresponding arm portion 72*a*. The direction of magnetic fluxes generated in the X-axis coil portions 73*a* is orthogonal to the direction of magnetic fluxes generated in the Y-axis coil portions 73*b*. Further, the X-axis coil portions 73*a* and the Y-axis coil portions 73*b* are formed substantially in the same plane in the thickness direction of the casing 81. The outer surfaces of the X-axis coil portions 73*a* and Y-axis coil portions 73*b* are almost flat in order to allow the core 71 to be properly installed. The X-axis coil portions 73*a* and the Y-axis coil portions 73*b* are connected together by the electric wires 74 at the crossing portion of the two core pieces 72.

Further, the Z-axis coil portion 73*c* is caught in a winding concave portion 86 formed in the tip surface of each cap 82*b*. The Z-axis coil portion 73*c* is constructed by winding the electric wire 74 along the shortest line passing around the caps 82*b* of the casing 81. The inner surface of each winding concave portion 86 is shaped generally like a circular arc as viewed from the direction shown in FIG. 3. Thus, when the Z-axis coil portion 73*c* is constructed by winding the electric wire 74 firmly, the electric wire 74 can be prevented from being cut. The direction of magnetic fluxes generated in the Z-axis coil portion 73*c* is orthogonal to the direction of magnetic fluxes generated in the X-axis coil portions 73*a* and Y-axis coil portions 73*b*. Further, ends of the electric wires 74 extended from the X-axis coil portions 73*a*, Y-axis coil portions 73*b*, and Z-axis coil portion 73*c* are connected to the connection portions 83*b* of the contacts 83. Some of the contacts 83 are not connected to the electric wire 74 but are used only to fix the three-axis antenna chip 70.

According to the present embodiment, the effects described below are obtained.

Figure 22:
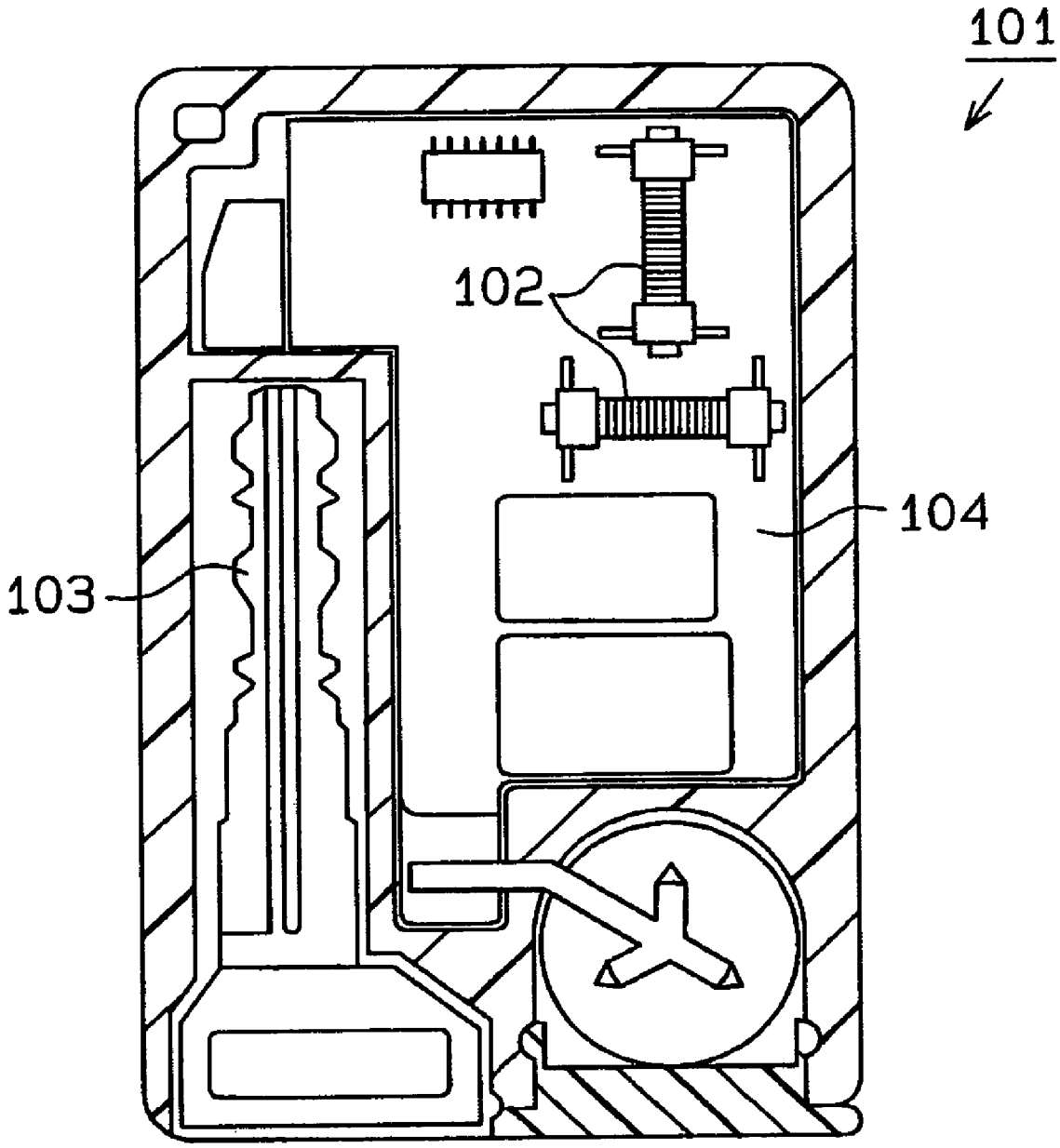
Fig.22 (Prior Art)
FIG. 22 is a sectional view of a portable transmitter-receiver according to the prior art.

(1) The three-axis antenna chip 70 is constructed by extending the four arm portions 72*a* in different directions, forming the X-axis coil portions 73*a* and Y-axis coil portions 73*b* around the arm portions 72*a*, and forming the Z-axis coil portion 73*c* by passing around the tips of the core pieces 72. Thus, the three-axis antenna chip 70 has the same functions as those of three on-axis antenna chips 102 (shown in FIG. 22) arranged in different directions (so as to cross at right angles). As a result, a mounting space required for the three-axis antenna chip 70 is smaller than a mounting space required for three one-axis antenna chips 102. That is, the size of the three-axis antenna chip 70 can be reduced. Therefore, the three-axis antenna chip 70 can be easily mounted in the portable transmitter-receiver 12.

Figure 8:
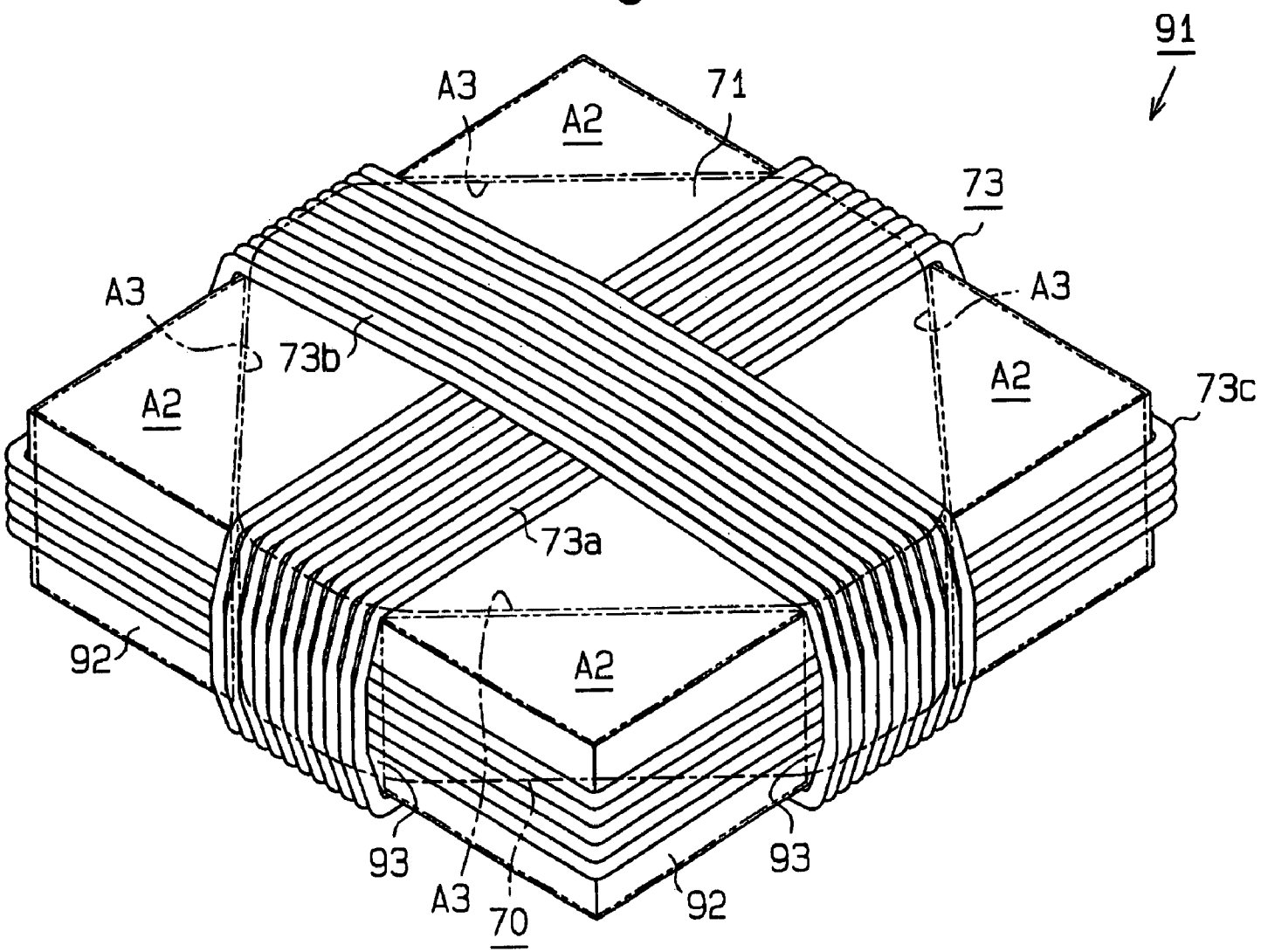
FIG. 8 is a perspective view of a three-axis antenna chip having a configuration different from that of the three-axis antenna chip in FIG. 3.

Further, the X-axis coil portions 73*a* and the Y-axis coil portions 73*b* do not overlap one another as in the case with a three-axis antenna chip 91, shown in FIG. 8. Accordingly, the three-axis antenna chip 70 is thinner than the three-axis antenna chip 91.

Furthermore, the X-axis coil portions 73*a* and the Y-axis coil portions 73*b* do not overlap the Z-axis coil portion 73*c* as in the case where the Z-axis coil portion 73*c* is arranged on a side of the core 71 which is opposite to the circuit board 29 (a three-axis antenna chip 70 according to a second embodiment, described below). Consequently, the three-axis antenna chip 70 may be thinner.

(2) The core 71 is shaped generally like a cross. Accordingly, spaces A1 are created each of which is surrounded by the adjacent arm portions 72*a* and the Z-axis coil portion 73*c* (as shown in FIG. 3). Thus, the spaces A1 can be effectively used for, e.g. another purpose. Specifically, electric components such as resistors which are unaffected by electromagnetic waves can be arranged in the spaces A1.

The three-axis antenna chip may be configured as shown in FIG. 8. Specifically, the three-axis antenna chip 91 has a rectangular core 71 which is formed with the X-axis coil portion 73*a*, the Y-axis coil portion 73*b*, and the Z-axis coil portion 73*c*. In this case, the Z-axis coil portion 73*c* is constructed by winding the electric wire 74 along sides of the core 71. Thus, the electric wire 74 cannot be wound along an imaginary line (an alternate long and two short dashes line) A3 corresponding to the contour of the three-axis antenna chip 70 according to the present embodiment. Accordingly, the three-axis antenna chip 91 is large-sized. Alternatively, it is contemplated that the core 71 may have the same size as that of the three-axis antenna chip 70. However, in this case, when the X-axis coil portion 73*a* and the Y-axis coil portion 73*b* are formed, the electric wire 74 may not be properly wound around winding surfaces 93. Thus, the three-axis antenna chip 70 according to the present embodiment has a smaller projection area than the three-axis antenna chip 91 in FIG. 8 as viewed from the thickness direction. In other words, with the three-axis antenna chip 70, it is possible to reduce the size of areas A2 surrounded by the imaginary line A3 and the Z-axis coil portion 73*c* as viewed from the thickness direction of the core 71. That is, it is possible to reduce a mounting area for the three-axis antenna chip 70 which must be provided in the circuit board 29.

Furthermore, since the core 71 is generally cross-shaped, the center of gravity of the three-axis antenna chip 91 is located in the crossing portion of the two core pieces 72, i.e. in their central portions. Thus, when the three-axis antenna chip 91 is mounted, a suction chuck can be used to suck the three-axis antenna chip 91 stably.

Further, compared to the generally T-shaped core 71, a uniform magnetic flux distribution is obtained when the Z-axis coil portion 73*c* is energized. This improves the sensitivity of the three-axis antenna chip 91.

(3) The core pieces 72 are each formed with the concave portion 72*b* in their crossing portion. Further, the inner side 72*c* of the concave portion 72*b* in one of the core pieces 72 contacts with the other core piece 72. This serves to make the core 71 much thinner. Furthermore, one of the core pieces 72 engages with the concave portion 72*b* formed in the other core piece 72. Accordingly, when the core 71 is produced, the core pieces 72 can be positioned to cross at right angles. Moreover, the core pieces 72 are flexible and are thus not broken when shocked. This prevents the shock resistance of the core 71 from being degraded when the core 71 is made thinner.

(4) Each core piece 72 consists of a magnetic substance and is constructed by stacking a plurality of flexible core sheets. Thus, even if the three-axis antenna chip 70 is shocked to, for example, break one core sheet and the other core sheets are not broken. Consequently, the whole core pieces 72 are not broken. This further improves the shock resistance of the three-axis antenna chip 70.

(5) The contacts 83 are provided at the opposite ends of each cap 82*b* and each comprise the mounting portion 83*a*, soldered to the circuit board 29. The contacts 83 may be provided at at least four positions in the three-axis antenna chip 70 or at six positions in order to facilitate the soldering of the electric wire 74. However, in the three-axis antenna chip 70 according to the present embodiment, the eight contacts 83 are provided, including those having the connection portion to which the end of the electric wire 74 is not connected. Thus, the three-axis antenna chip 70 can be fixed more reliably. Furthermore, the each contact 83 is provided on the corresponding cap 82*b*. Therefore, the three-axis antenna chip 70 can be fixed more reliably than in the case where each contact 83 is disposed near the crossing portion of the two core pieces 72.

(6) The core 71 is accommodated in the casing 81 and can thus be easily positioned in the thickness direction of the three-axis antenna chip 70. Further, the casing 81 can be provided with the winding concave portion 86. This facilitates the formation of the Z-axis coil portion 73*c*.

A second embodiment of the present invention will be described below with reference to FIGS. 9 and 10. In the second embodiment, the detailed description of elements similar to those in the first embodiment is omitted.

Figure 9:
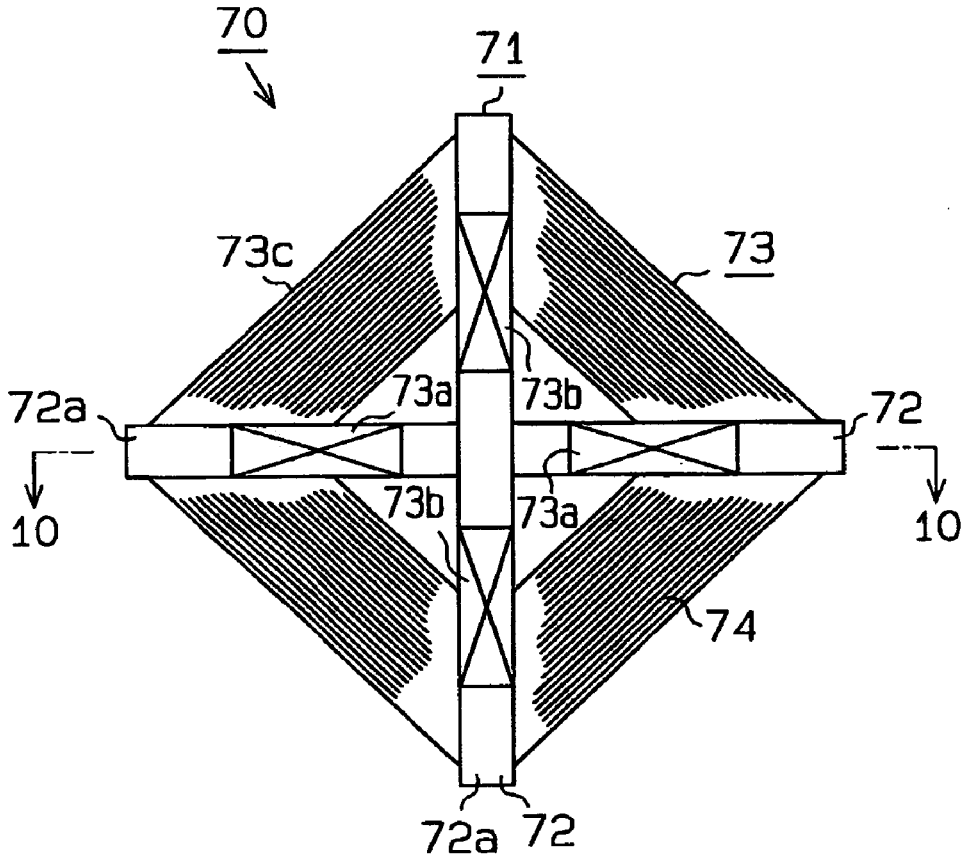
FIG. 9 is a bottom view of a three-axis antenna chip according to a second embodiment of the present invention.
Figure 10:
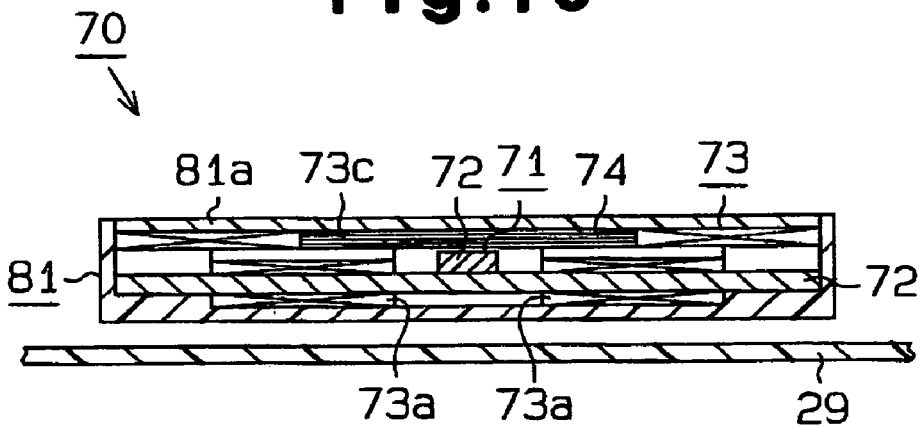
FIG. 10 is a sectional view taken along line 10—10 in FIG. 9.

As shown in FIGS. 9 and 10, the casing 81 contains the core 71 around which the X-axis coil portions 73*a* and the Y-axis coil portions 73*b* are formed as well as the Z-axis coil portion 73*c*. An opening in the casing 81 is covered with a cover 81*a*. The Z-axis coil portion 73*c* is arranged, in the thickness direction of the core 71, opposite the circuit board 29, in which the three-axis antenna chip 70 is mounted. The Z-axis coil portion 73*c* is rectangular and annular. The Z-axis coil portion 73*c* is formed by winding the electric wire 74 along lines that are parallel to the shortest line passing through the tips of the core pieces 72. The corner portions of the Z-axis coil portion 73*c* coincide with the corresponding tip edges of the core pieces 72 in the thickness direction of the three-axis antenna chip 70. The outer peripheral edge of the Z-axis coil portion 73*c* does not project outward from the tip edges of the core pieces 72.

Therefore, according to the present embodiment, the effects described below can be produced.

(7) The Z-axis coil portion 73*c* is arranged, in the thickness direction of the core 71, opposite the circuit board 29, in which the three-axis antenna chip 70 is mounted. Thus, the extent to which the Z-axis coil portion 73*c* can be formed can be increased compared to the three-axis antenna chip 70 according to the first embodiment, in which the Z-axis coil portion 73*c* is formed by winding the electric wire 74 along the tip surfaces of the core pieces 72. This serves to increase the sensitivity of the three-axis antenna chip 70 in a Z axis direction.

Further, each core piece 72 can be elongated only by an amount corresponding to the thickness of the Z-axis coil portion 73*c* in a longitudinal direction, compared to the first embodiment. Nevertheless, it is possible to improve significantly the sensitivity of the three-axis antenna chip 70 in the X axis direction and the Y axis direction.

Accordingly, the sensitivity of the three-axis antenna chip 70 can be improved without increasing the mounting area for the three-axis antenna chip 70, which must be provided in the circuit board 29. Specifically, even if the mounting area for the three-axis antenna chip 70 is predetermined, the sensitivity of the three-axis antenna chip 70 can be improved.

(8) The electric wire 74 forming the Z-axis coil portion 73*c* is arranged so as not to project outward from the tips of the core pieces 72. In this case, if the core pieces 72 are not elongated in the longitudinal direction, the size of the three-axis antenna chip 70 can be reduced in the longitudinal direction of each core piece 72 without reducing the sensitivity of the three-axis antenna chip 70. It is thus possible to further reduce the mounting area for the three-axis antenna chip 70, which must be provided in the circuit board 29. This is advantageous in miniaturizing the portable transmitter-receiver 12.

A third embodiment of the present invention will be described with reference to FIGS. 11 to 13. In the third embodiment, the detailed description of elements similar to those in the first embodiment is omitted.

Figure 11:
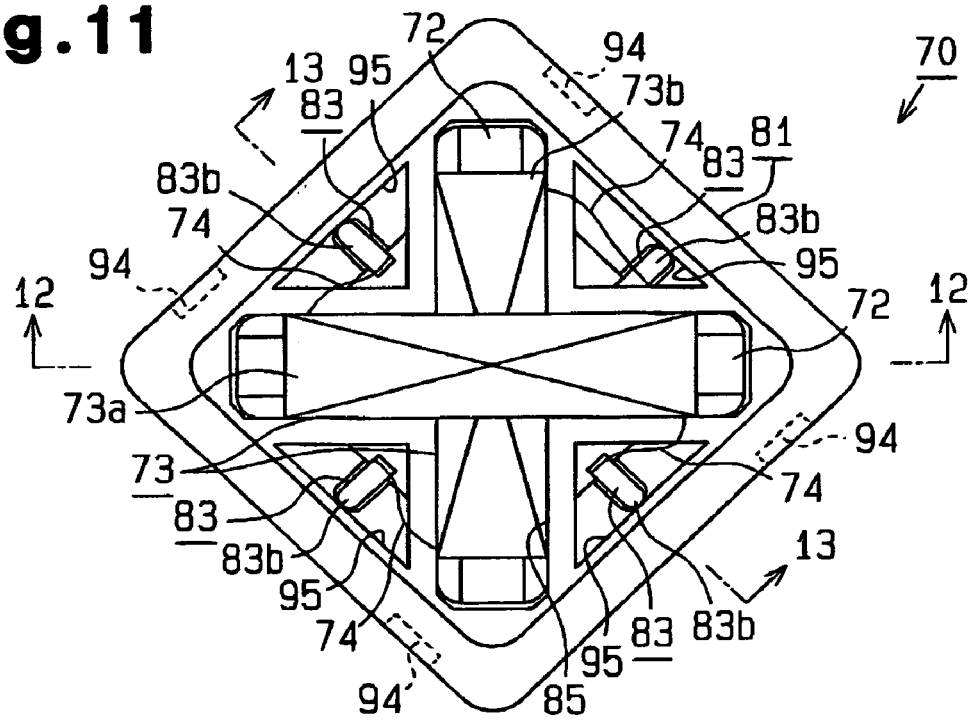
FIG. 11 is a front view of a three-axis antenna chip according to a third embodiment of the present invention.
Figure 12:
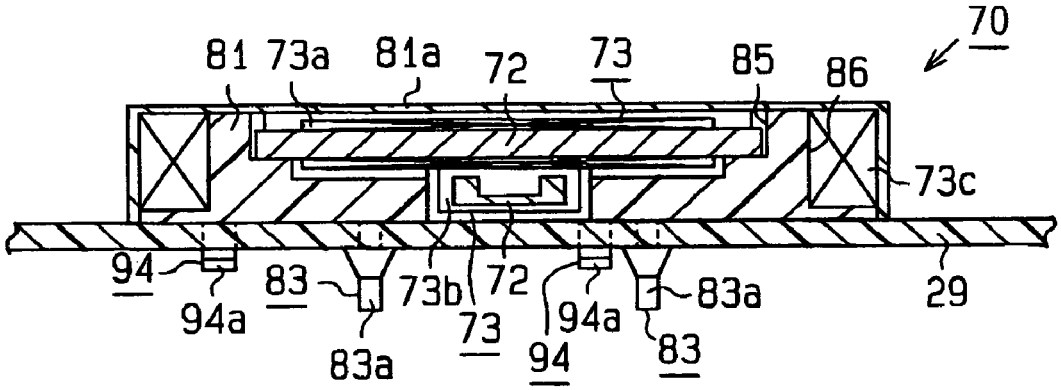
FIG. 12 is a sectional view taken along line 12—12 in FIG. 11.
Figure 13:
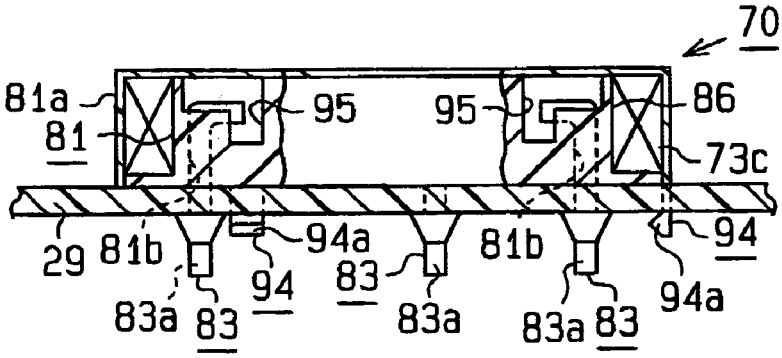
FIG. 13 is a sectional view taken along line 13—13 in FIG. 11.

As shown in FIGS. 11 to 13, the casing 81 is covered with a box-like cover 81*a* the bottom of which is open. Four claw portions 94 project from a surface of the casing 81 which is closer to the circuit board 29. The claw portions 94 are arranged so that their outer sides coincide with the outer peripheral edges of the casing 81. An engaging claw 94*a* projects from each claw portion 94. Each engaging claw 94*a* is engaged so that the corresponding claw portion 94 penetrates the circuit board 29.

The casing 81 is formed with a generally cross-shaped accommodating concave portion 85. Further, the casing 81 is formed with generally triangular accommodating concave portions 95 each surrounded by the accommodating concave portion 85 and the outer periphery of the casing 81.

The accommodating concave portion 85 accommodates the X-axis coil portion 73*a* formed by winding the electric wire 74 around one of the core pieces 72 and the Y-axis coil portion 73*b* formed by winding the electric wire 74 around the other core piece 72. Each of the core pieces 72 forms an arm portion, which has the corresponding coil portion 73*a*, 73*b* provided about it. The electric wires 74 forming the X-axis coil portion 73*a* and the Y-axis coil portion 73*b* are wound around almost all of the respective core pieces 72. In other words, the X-axis coil portion 73*a* is provided both in a section of the X-axis core piece 72 that is laid on top of the Y-axis core piece 72 and in a section of the X-axis core piece 72 that is not laid on top of the Y-axis core piece 72. Also, the Y-axis coil portion 73*b* is provided both in a section of the Y-axis core piece 72 that is laid on top of the X-axis core piece 72 and in a section of the Y-axis core piece 72 that is not laid on top of the X-axis core piece 72. The X-axis coil portion 73*a* and the Y-axis coil portion 73*b* are formed on the respective core pieces 72 before the core pieces 72 are laid on top of each other in their central portions so as to be generally cross-shaped. Specifically, the X-axis coil portion 73*a* and the Y-axis coil portion 73*b* are accommodated in the accommodating concave portion 85 by winding the electric wire 74 around each core piece 72 to form the X-axis coil portion 73*a* and the Y-axis coil portion 73*b* and then laying the core pieces 72 on top of each other in their central portions so that they are generally cross-shaped.

Each accommodating concave portion 95 is provided with one contact 83. Specifically, the contacts 83 are provided at four positions in the three-axis antenna chip 70. Three contacts 83 are arranged at an equal distance from the X-axis coil portion 73*a* and from the Y-axis coil portion 73*b*. The remaining one contact 83 is arranged closer to the X-axis coil portion 73*a*. Accordingly, the contacts 83 are arranged laterally asymmetrically with respect to the X-axis coil portions 73*a* and Y-axis coil portions 73*b* when the three-axis antenna chip 70 is viewed from its thickness direction.

As shown in FIG. 13, each contact 83 is pressed in a through-hole 81*b* formed in the casing 81. The contact 83 has a circular cross section and has the mounting portion 83*a*, projected from the casing 81 to the circuit board 29, and the connection portion 83*b*, connected to the end of the mounting portion 83*a* and projected into the accommodating concave portion 95. The three-axis antenna chip 70 is fixed by soldering so that the mounting portions 83*a* penetrate the circuit board 29.

Thus, according to the present embodiment, the effects described below can be produced.

(9) The three-axis antenna chip 70 is produced by laying the two core pieces 72 on top of each other, the electric wire 74 being already wound around each of the core pieces 72. Accordingly, when the three-axis antenna chip 70 is produced, the electric wire 74 can be wound around the overlapping portion of the two core pieces 72. Consequently, compared to the case in which the three-axis antenna chip 70 is produced by laying the two core pieces 72 on top of each other and then winding the electric wire 74 around each core piece 72, the extent to which the X-axis coil portion 73*a* and the Y-axis coil portion 73*b* can be formed can be increased by an amount corresponding to the overlapping portion of the two core pieces 72. Thus, the sensitivity of the three-axis antenna chip 70 can be increased in the X and Y axis directions. Therefore, the sensitivity of the three-axis antenna chip 70 can be improved without increasing the mounting area for the three-axis antenna chip 70, which must be provided in the circuit board 29.

Further, in the first and second embodiments, the X-axis coil portions 73*a* and Y-axis coil portions 73*b* are formed by winding the electric wire 74 around the arm portions 72*a*. It is accordingly necessary to perform four operations of winding the electric wire 74. In contrast, in the present embodiment, the X-axis coil portion 73*a* and the Y-axis coil portion 73*b* are formed by winding the electric wire 74 almost all around each core piece 72. It is thus necessary to perform only two operations of winding the electric wire 74. This allows the three-axis antenna chip 70 to be produced easily and efficiently.

Furthermore, if the X-axis coil portion 73*a* and the Y-axis coil portion 73*b* are formed, it is possible to use a conventional facility used to produce the one-axis antenna 102. This makes it possible to reduce the production cost of the three-axis antenna chip 70.

(10) The mounting portion 83*a* of the contact 83 is soldered to the circuit board 29 so as to penetrate it. Thus, the three-axis antenna chip 70 is fixed not only by the adhesive force of solder, as in the first and second embodiments, but also by the frictional force between the outer peripheral surface of the mounting portion 83*a* and the circuit board 29. Moreover, a solder fillet is formed in the connection between the mounting portion 83*a* and the circuit board 29. This improves the fixation intensity of the three-axis antenna chip 70.

(11) The contacts 83 are arranged laterally asymmetrically with respect to the X-axis coil portions 73*a* and Y-axis coil portions 73*b* when the core pieces 72 are viewed from their thickness direction. Thus, if an attempt is made to mount the three-axis antenna chip 70 on the circuit board 29 in the incorrect direction, the contacts 83 cannot be penetrated through the circuit board 29. This prevents the malfunctioning of the portable transmitter-receiver 12 resulting from the incorrect mounting of the three-axis antenna chip 70.

(12) The claw portion 94 is arranged on the side of each core piece 72 which is closer to the circuit board 29 in the thickness direction of the claw portion 94, with the claw portion 94 engaging with and penetrating through the circuit board 29. Thus, when the circuit board 29 is turned upside down in order to allow the three-axis antenna chip 70 to be soldered to it, the three-axis antenna chip 70 does not slip off from the circuit board 29 because it is temporarily locked on the circuit board 29 using the claw portions 94. This facilitates the mounting of the three-axis antenna chip 70.

Further, the three-axis antenna chip 70 may be fixed to the circuit board 29, not only by soldering the contacts 83 to the circuit board 29, but also by engaging the claw portions 94 with the circuit board 29. This further improves the fixation strength of the three-axis antenna chip 70.

Figure 14:
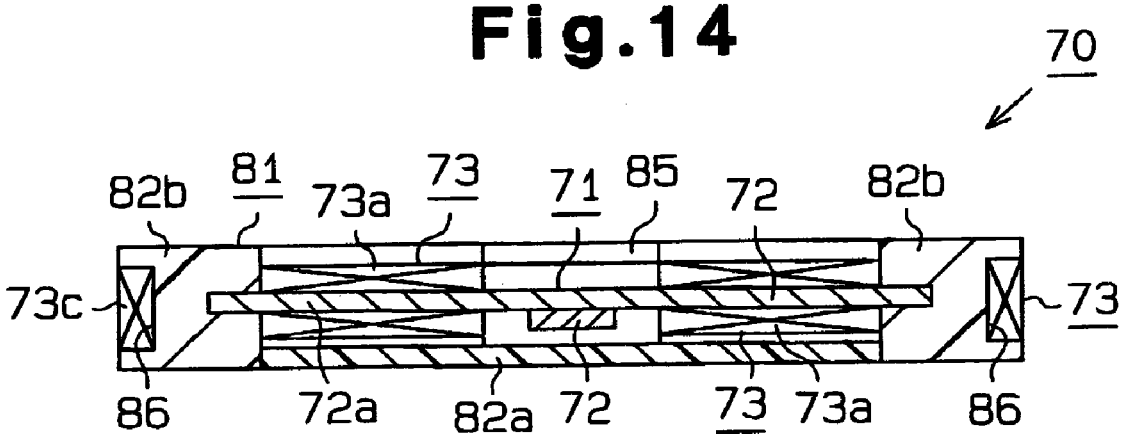
FIG. 14 is a sectional view of a three-axis antenna chip according to another embodiment.
Figure 15:
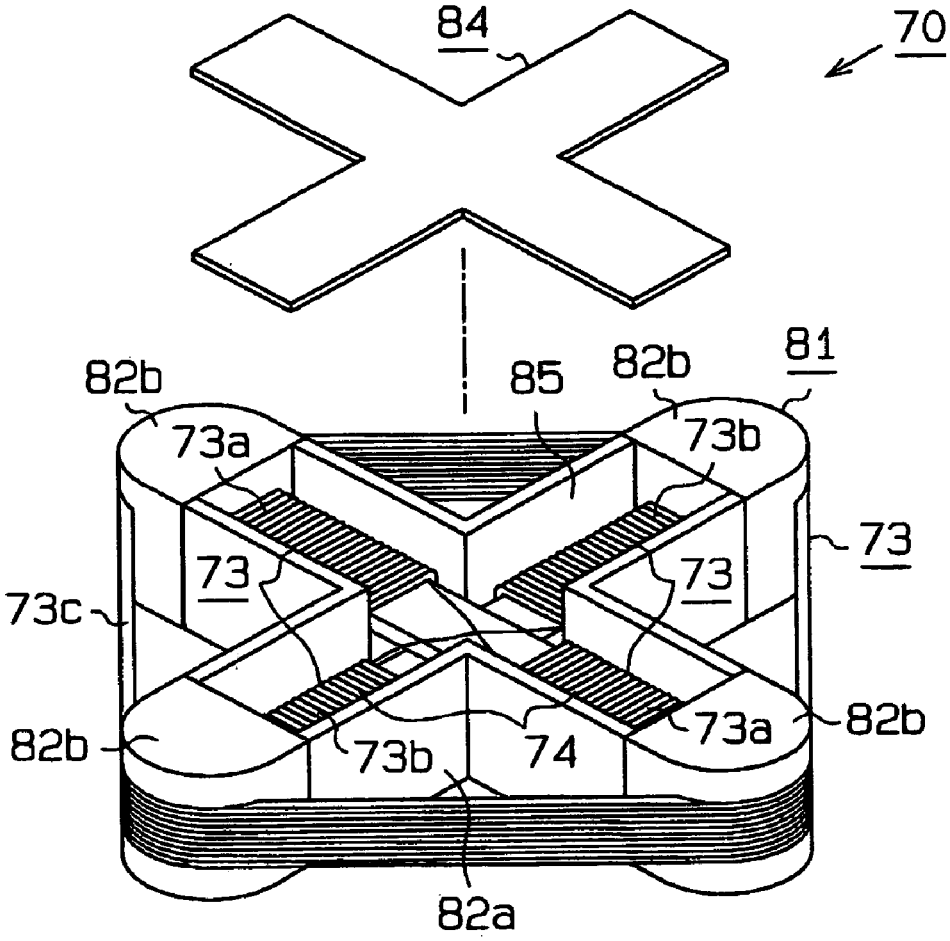
FIG. 15 is a perspective view of the three-axis antenna chip in FIG. 14.
Figure 16:
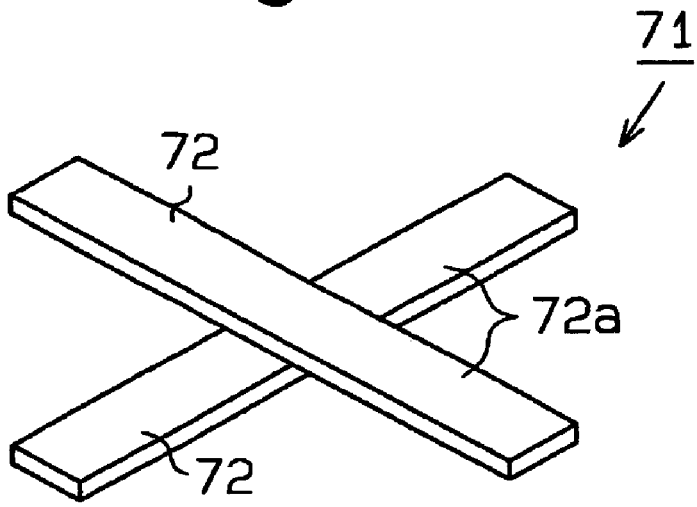
FIG. 16 is a perspective view showing a core provided in the three-axis antenna chip in FIG. 14.

The above embodiments may be altered as follows:

The core pieces 72 may be formed by sintering. FIGS. 14 to 16 show an example of the three-axis antenna chip 70 including the core pieces 72 formed by sintering.

Figure 17:
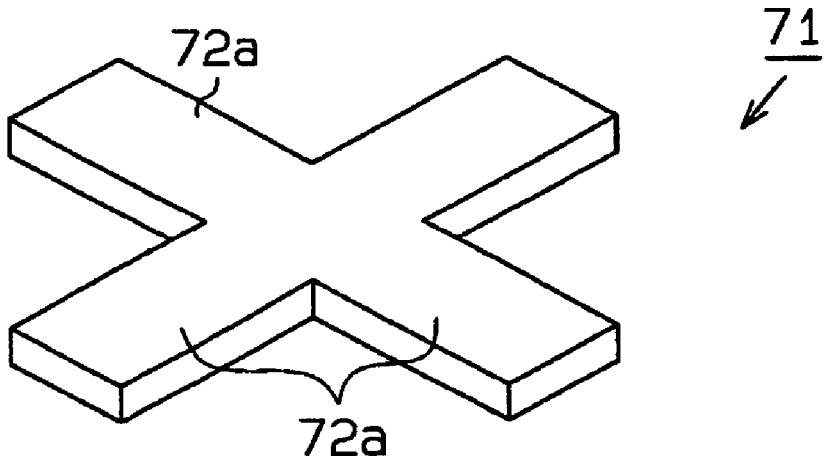
FIG. 17 is a perspective view showing a core according to another embodiment.

In the above embodiments, as shown in FIG. 17, the core 71 may be integral. If the core 71 is formed of an amorphous alloy, it is formed by stacking a plurality of generally cross-shaped core sheets. Alternatively, if the core 71 is formed of ferrite, it is formed by press molding. With this arrangement, the directions of the arm portions 72*a* are set beforehand, so that the arm portions 72*a* can be reliably positioned. This ensures that the three-axis antenna chip 70 can be mounted. It is also possible to prevent the three-axis antenna chip 70 from becoming thicker.

In the above embodiments, the core 71 may be generally T-shaped by laying the two core pieces on top of each other. Alternatively, the core 71 may be integrally formed so as to be generally T-shaped.

In the above embodiments, the concave portion 72*b* may be formed by bending the crossing portion of only one of the core pieces 72 in their thickness direction.

In the first embodiment, the contacts 83 are provided at the respective sides of the corresponding cap 82*b*. However, each contact 83 may be provided at the corresponding tip edge of the cap 82*b*. In this case, the contacts 83 are provided at totally four positions in the three-axis antenna chip 70.

Figure 18:
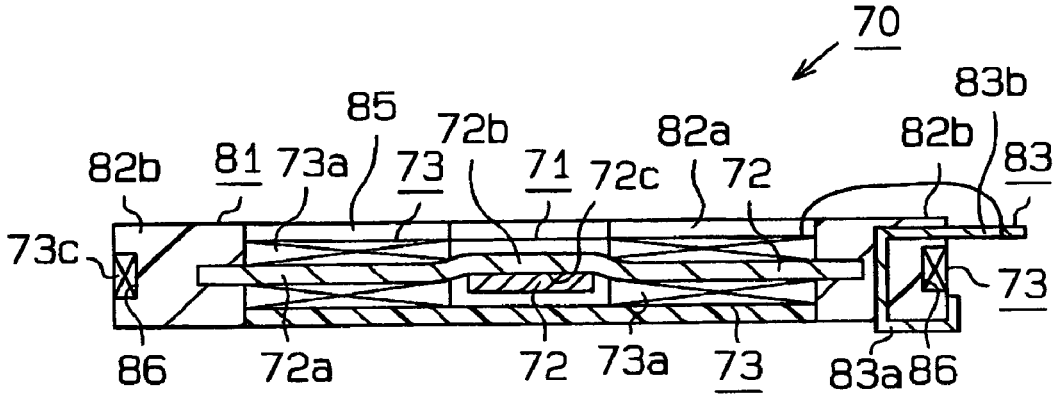
FIG. 18 is a sectional view of a three-axis antenna chip according to another embodiment.
Figure 19:
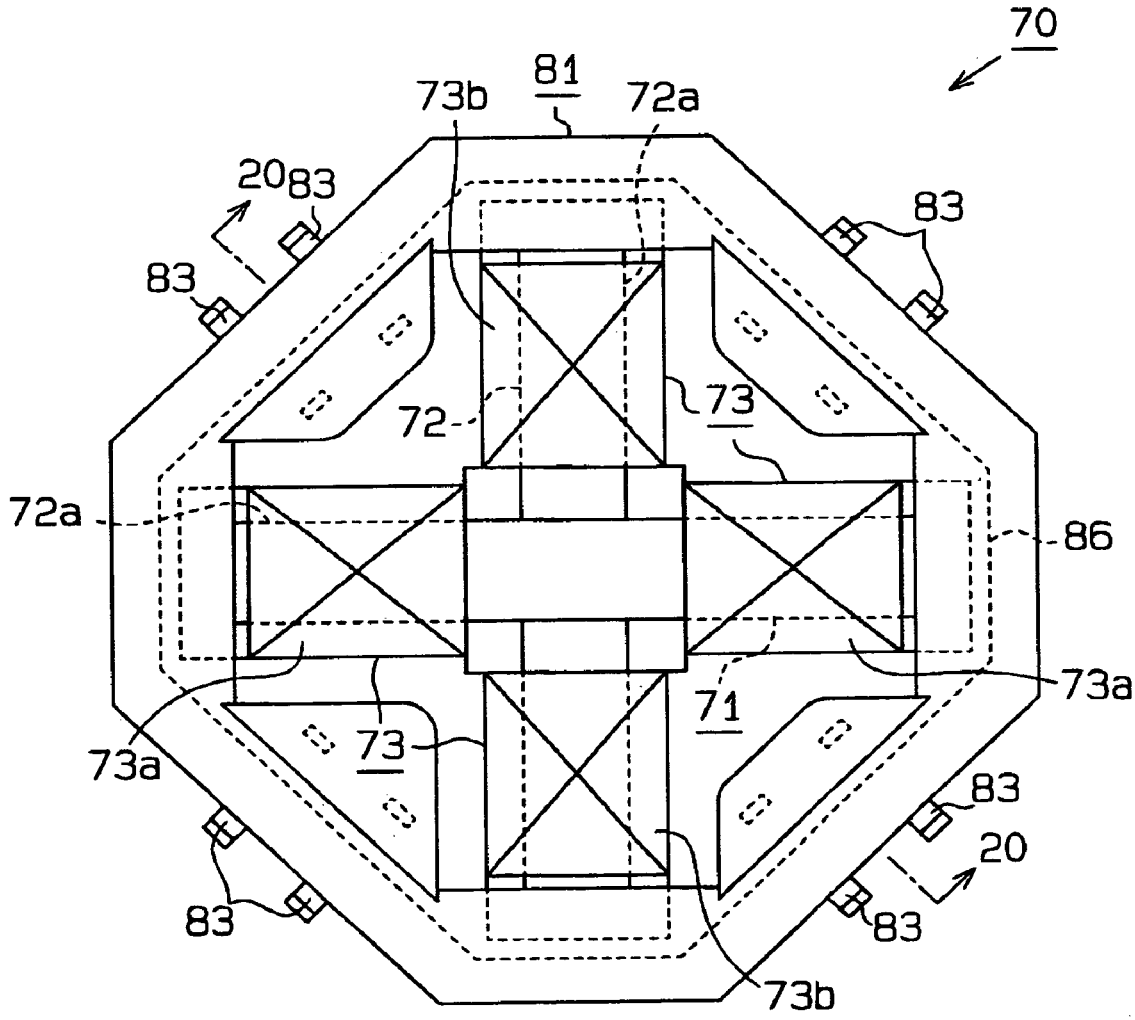
FIG. 19 is a front view of a three-axis antenna chip according to another embodiment.
Figure 20:
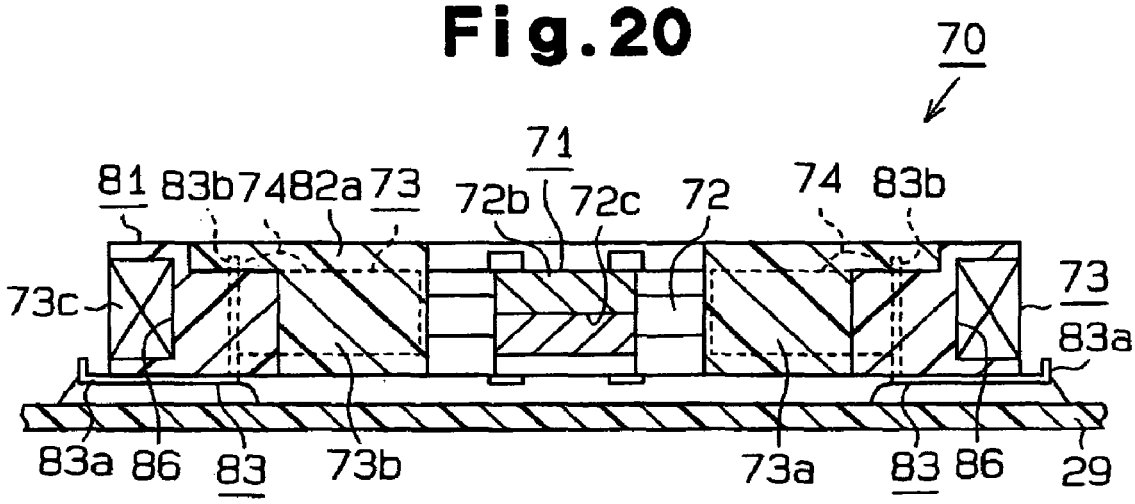
FIG. 20 is a sectional view taken along line 20—20 in FIG. 19.

As shown in FIGS. 19 and 20, each contact 83 may be provided in the area surrounded by the adjacent arm portions 72*a* and the Z-axis coil portion 73*c* (the area corresponding to the space A1 in the above embodiments). This arrangement serves to reduce the size of the three-axis antenna chip 70 compared to the case in which each contact 83 is provided at the corresponding tip edge of the cap 82*b* (as shown in FIG. 18). Further, even if the mounting portion 83*a* is set be longer than that in the above embodiments, it does not interfere with the coil portion 73. This makes it possible to increase the contact area between the three-axis antenna chip 70 and the circuit board 29. Therefore, the three-axis antenna chip 70 can be mounted more easily.

In the second embodiment, the Z-axis coil portion 73*c* may be arranged on the side of the core 71 which is closer to the circuit board 29. Alternatively, the Z-axis coil portion 73*c* may be arranged on both the side of the core 71 that is closer to the circuit board 29 and on its opposite side. This arrangement allows the Z-axis coil portion 73*c* to be doubled to increase the sensitivity of the three-axis antenna chip 70 in the Z axis direction.

Figure 21:
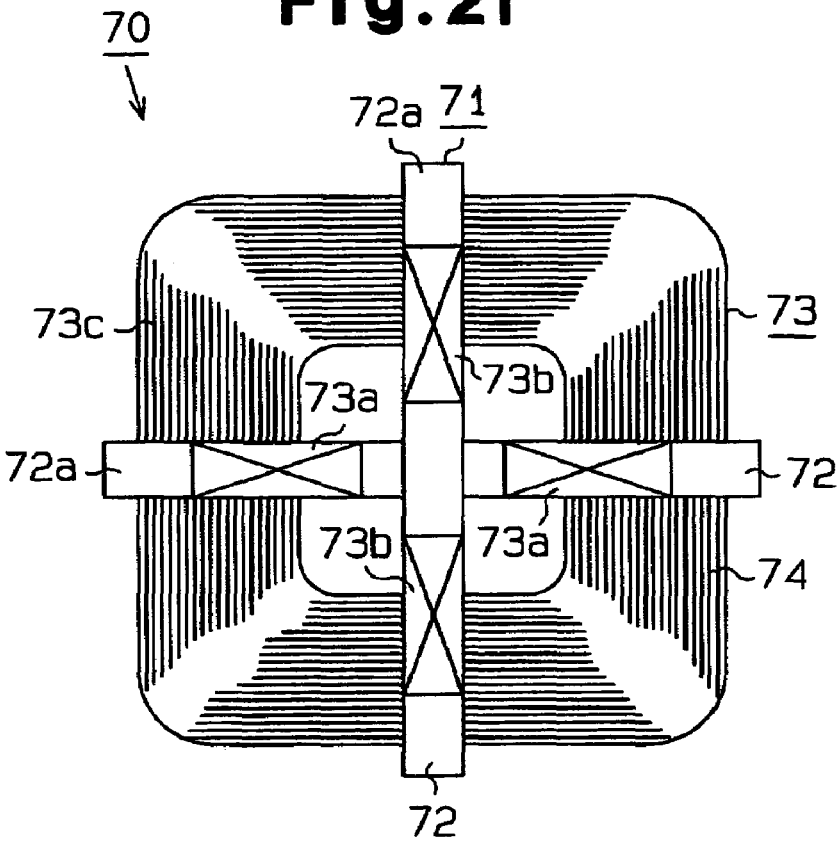
FIG. 21 is a bottom view of a three-axis antenna chip according to another embodiment.

In the second embodiment, the electric wire 74 forming the Z-axis coil portion 73*c* need not be wound along lines that are parallel to the shortest line passing around the tips of the core pieces 72. That is, for example, as shown in FIG. 21, the corner portions of the Z-axis coil portion 73*c* need not coincide with the corresponding tip edges of the core pieces 72 in the thickness direction of the three-axis antenna chip 70.

In the above embodiments, the core pieces 72 may not be accommodated in the casing 81 but may be mounted directly on the circuit board 29.

Therefore, the present examples and embodiments are to be considered as illustrative and not restrictive and the invention is not to be limited to the details given herein, but may be modified within the scope and equivalence of the appended claims.

The invention claimed is:

1. A multiaxial antenna chip, comprising:

a generally cross-shaped core, which includes an X-axis arm portion and an Y-axis arm portion extending perpendicular to each other;

an X-axis coil portion provided about the X-axis arm portion;

an Y-axis coil portion provided about the Y-axis arm portion;

a Z-axis coil portion provided about a Z-axis that extends perpendicular to the X-axis arm portion and the Y-axis arm portion; and a casing defining an accommodating concave portion, wherein the accommodating concave portion has a shape corresponding to that of the core, wherein the accommodating concave portion accommodates the core equipped with the coil portions such that the core is positioned in the accommodating concave portion, wherein the casing has a winding concave portion formed at its periphery, the Z-axis coil portion being wound about the casing and being received in the winding concave portion.

2. The multiaxial antenna chip according to claim 1, wherein the casing is shaped generally like a cross and has four radially outer tips, wherein the Z-axis coil portion is formed by winding an electric wire along lines that are parallel to lines passing through the tips of the casing.

3. The multiaxial antenna chip according to claim 2, wherein the casing includes caps provide at the four tips, each cap having the winding concave portion.

4. The multiaxial antenna chip according to claim 1, wherein the casing is shaped generally like a square, wherein the core is accommodated in the accommodating concave portion so that the X-axis arm portion and the Y-axis arm portion extend along the diagonal lines of the casing, each diagonal line joining opposite corners of the square casing.

5. The multiaxial antenna chip according to claim 1, further comprising a plurality of contacts, which are insert-molded in the casing or are pressed in a through-hole formed in the casing, each contact being connected to one of the coil portions, wherein the contacts extend through, and are fixed to, a circuit board on which the multiaxial antenna chip is mounted.

6. The multiaxial antenna chip according to claim 1, further comprising a claw portion, wherein the claw portion extends through, and is engaged with, a circuit board on which the multiaxial antenna chip is mounted.

7. The multiaxial antenna chip according to claim 1, wherein the core includes an X-axis core piece and a Y-axis core piece, wherein the core pieces extend perpendicular to each other and are laid on top of each other, and wherein the X-axis core piece includes the X-axis arm portion, and the Y-axis core piece includes the Y-axis arm portion.

8. The multiaxial antenna chip according to claim 7, wherein the core pieces are laid on top of each other such that portions of the core pieces that are not laid on top of each other are in the same plane.

9. The multiaxial antenna chip according to claim 7, wherein at least one of the core pieces has a concave portion at a section that is laid on top of the other core piece, wherein the other core piece is engaged with the concave portion.

10. The multiaxial antenna chip according to claim 7, wherein at least one of the core pieces is bent such that a section that is laid on top of the other core piece is displaced relative to the remainder of the bent core piece in a direction away from the other core piece.

11. The multiaxial antenna chip according to claim 7, wherein the X-axis coil portion is provided only in a section of the X-axis core piece that is not laid on top of the Y-axis core piece, and wherein the Y-axis coil portion is provided only in a section of the Y-axis core piece that is not laid on top of the X-axis core piece.

12. The multiaxial antenna chip according to claim 7, wherein the X-axis coil portion is provided both in a section of the X-axis core piece that is laid on top of the Y-axis core piece and in a section of the X-axis core piece that is not laid on top of the Y-axis core piece, and wherein the Y-axis coil portion is provided both in a section of the Y-axis core piece that is laid on top of the X-axis core piece and in a section of the Y-axis core piece that is not laid on top of the X-axis core piece.

13. The multiaxial antenna chip according to claim 1, wherein the X-axis arm portion is a pair of X-axis arm portions that extend in opposite directions from a center of the core, wherein the Y-axis arm portion is a pair of Y-axis arm portions that extend in opposite directions from the center of the core, wherein the X-axis coil portion is a pair of X-axis coil portions, each corresponding to one of the X-axis arm portions, and wherein the Y-axis coil portion is a pair of Y-axis coil portions, each corresponding to one of the Y-axis arm portions.

14. The multiaxial antenna chip according to claim 1, wherein the core is flexible.

15. The multiaxial antenna chip according to claim 14, wherein the core is constructed by stacking a plurality of flexible sheets.

16. The multiaxial antenna chip according to claim 1, wherein the casing is made of a synthetic resin.

17. The multiaxial antenna chip according to claim 1, wherein the accommodating concave portion has an opening, the opening being covered with a cover.

* * * * *